United States Patent [19]

Ferris

[11] Patent Number: 4,802,304

[45] Date of Patent: Feb. 7, 1989

[54] CUT FLOWER STORAGE AND DISPLAY UNIT AND SYSTEM

[76] Inventor: John Ferris, 46 Arbolado Dr., La Selva Beach, Calif. 95076

[21] Appl. No.: 927,648

[22] Filed: Nov. 5, 1986

[51] Int. Cl.[4] ..... A01G 5/00

[52] U.S. Cl. ..... 47/41 R

[58] Field of Search ..... 47/41 R, 41.12, 41.11, 47/41, 66, 40, 68, 67, 33, 82–84; 220/1 R, DIG. 13; 211/41, 71; 206/423; 232/45; 248/27.8

[56] References Cited

U.S. PATENT DOCUMENTS

| | | | |
|---|---|---|---|
| 338,845 | 3/1886 | Kift | 248/27.8 |
| 1,777,944 | 10/1930 | Trovato | 47/41 |
| 1,990,522 | 2/1935 | Bowie | 47/41 |
| 2,686,988 | 8/1954 | Garber | 47/41 |
| 2,878,618 | 3/1959 | Trombetta | 47/41 |

FOREIGN PATENT DOCUMENTS

| | | | |
|---|---|---|---|
| 916241 | 8/1954 | Fed. Rep. of Germany | 47/82 |
| 3416208 | 11/1984 | Fed. Rep. of Germany | 47/66 |
| 3527058 | 2/1987 | Fed. Rep. of Germany | 47/67 |
| 2231309 | 1/1975 | France | 47/68 |

*Primary Examiner*—James R. Feyrer

*Attorney, Agent, or Firm*—Flehr, Hohbach, Test, Albritton & Herbert

[57] ABSTRACT

A container (10) is especially constructed for holding cut flowers (12). The container (10) has a flat bottom (14), on which the flowers (12) rest when the container is oriented with the bottom (14) angling upward at an angle of 40 degrees. Sides (16, 18, 20, 22) and top (24), with the bottom (14), form a reservoir (26) for water (28) at end (30) of the container (10). A rack (50) holds the containers (10) at the angle of 40 degrees. A tower (110) holds the rack (50) with the containers (10) at the angle of 40 degrees.

5 Claims, 5 Drawing Sheets

CUT FLOWER STORAGE AND DISPLAY UNIT AND SYSTEM

BACKGROUND OF THE INVENTION

1. Field of the Invention

This invention relates to a novel storage and display container for cut flowers, to a rack for holding a number of the containers in a stacked relationship, and to a storage and display system incorporating the container and rack. More particularly, it relates to such a container, rack and system which increases the density with which cut flowers may be stored and displayed in a given amount of floor space and allows the cut flowers to be more conveniently handled in a store and its associated storage facilities.

2. Description of the Prior Art

Cut flowers have conventionally been sold in the United States as arrangements. More recently, a trend has developed in this country toward the sale of cut flowers in bunches or by the stem, a practice that has hitherto been more common in Europe. The consumer then arranges such flowers after purchase, or may simply place them in a vase for display. Such cut flowers are typically stored in coolers and displayed at the point of sale in buckets or similar containers of water to maintain freshness in flower shops and supermarkets. This usual manner of storing and displaying cut flowers requires a comparatively large amount of expensive refrigerated and retail sales space.

A variety of structures have been proposed in the prior art for reducing space required for growing plants. Examples of such structures are shown in the following issued U.S. Pat. Nos. 1,217,239, issued Feb. 27, 1917 to Swartz; 3,293,798, issued Dec. 27, 1966 to Johnson, Sr.; 3,374,574, issued Mar. 26, 1968 to Haile; 3,447,261, issued June 3, 1969 to Hundt; 3,452,475, issued July 1, 1969 to Johnson, Sr.; 3,445,055, issued July 15, 1969 to Chute; 4,123,873, issued Nov. 7, 1978 to Canova; 4,334,387, issued June 15, 1982 to Karpisek; 4,355,485, issued Oct. 26, 1982 to Frank and 4,380,136, issued Apr. 19, 1983 to Karpisek.

Despite the availability of such structures for growing plants, a similar development of space efficient structures for storing and displaying cut flowers has not taken place. The state of the art for conserving space in the storage of cut flowers in refrigerated space is indicated by an article entitled "Adjustable Storage Shelves", Florist's Review, July 1986.

SUMMARY OF THE INVENTION

Accordingly, it is an object of this invention to provide a storage and display container especially adapted for cut flowers.

It is another object of the invention to provide such a storage and display container which is configured for stacking arrangement on a rack to conserve floor space.

It is a further object of the invention to provide a storage and display system incorporating such a container and rack which makes movement of cut flowers from storage areas to display areas easier.

It is still another object of the invention to provide such a storage and display container which is also readily usable for making mixed bouquets of cut flowers.

These and related objects may be achieved through use of the novel cut flower storage and display container, rack and system herein disclosed. A cut flower display container in accordance with this invention has a flat bottom and a pair of sides extending from an end of the flat bottom partly along opposite sides of the flat bottom. At least a third side extends along the end of the flat bottom between the pair of sides. A top extends between the pair of sides. The sides, bottom and top define a reservoir for a liquid at the end of the flat bottom. The reservoir has an open side facing away from the end of the flat bottom. The flat bottom extends beyond the reservoir to provide support for the stems of the flowers. The reservoir serves to confine the liquid at the end of the flat bottom when the flat bottom is angled upward from the end.

A rack for holding a plurality of the containers in accordance with the invention includes a plurality of vertical support members. A plurality of laterally extending braces are provided between pairs of the vertical support members. A plurality of parallel angle supports for the containers extend between adjacent ones of the vertical support members at right angles to the laterally extending braces. The angle supports are at the predetermined angle between the adjacent ones of the vertical support members. The braces are dimensioned to allow the plurality of containers to rest on the plurality of angle supports.

A movable tower for holding a plurality of the racks in accordance with the invention has a base with a plurality of casters on the base. A plurality of vertical supports extend upward from the base. A plurality of braces extend laterally between the vertical supports. A plurality of the racks are supported along the vertical supports. In one form of the movable tower, a plurality of angle supports are at right angles to the braces. The plurality of angle supports extend between adjacent ones of the vertical supports at the predetermined angle. The braces are dimensioned to allow the plurality of racks to rest on the plurality of angle supports.

The container allows the cut flowers to be both stored and displayed under conditions that will maintain their freshness. The rack allows the cut flowers to be stored and displayed in a space-efficient manner. The tower allows the racks and containers to be moved from storage to display and back easily.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
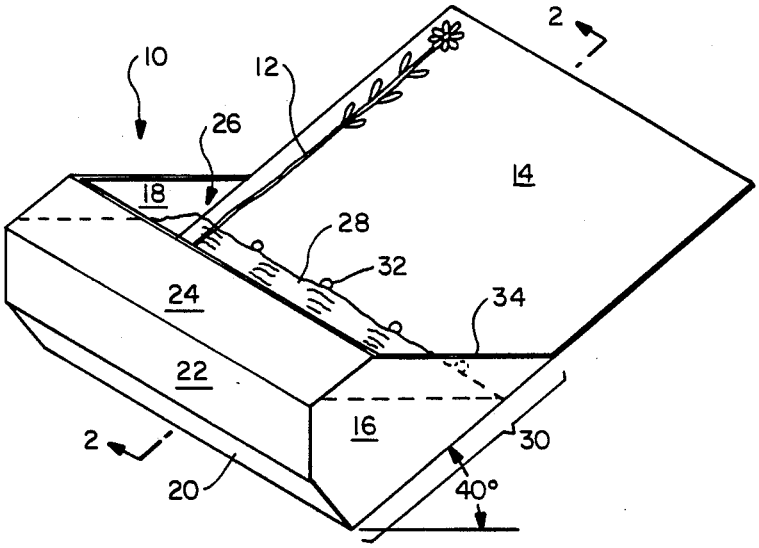
FIG. 1 is a perspective view of a container for cut flowers in accordance with the invention.
Figure 2:
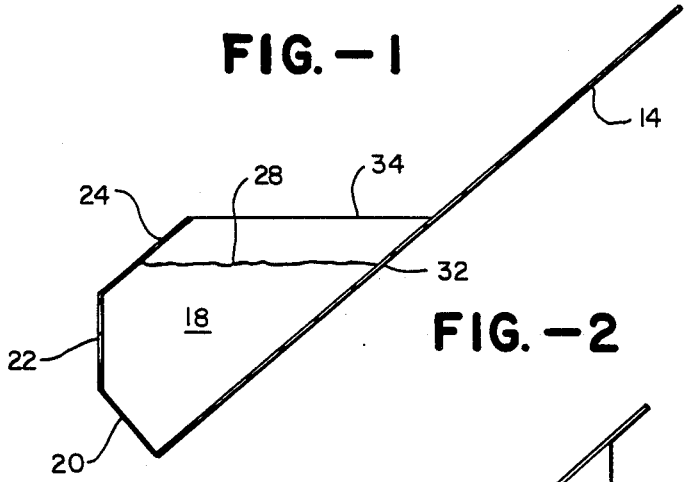
FIG. 2 is a cross-section view taken along the line 2—2 in FIG. 1.

Turning now to the drawings, more particularly to FIGS. 1 and 2, there is shown a container 10 especially constructed for holding cut flowers 12. The container 10 has a flat bottom 14, on which the flowers 12 rest when the container is oriented as shown, with the bottom 14 angling upward at an angle of from about 30 to about 50 degrees, preferably about 40 degrees. Sides 16, 18, 20, 22 and top 24, with the bottom 14, form a reservoir 26 for water 28 at end 30 of the container 10. Bottom 14 has a plurality of holes 32 extending along a line between the sides 16 and 18 and positioned inside edges 34. The holes 32 serve to limit the depth of the water 28 when the container 10 is inclined as shown, by allowing excess water to drain from the reservoir 26. The holes 32 are located about 6 inches from side 20 of the reservoir. With this positioning of the holes 32 and the container 10 inclined as shown, the depth of the water 28 is correct for maintaining the cut flowers 12 fresh.

In practice, the container 10 is desirably fabricated from a fairly rigid plastic material, such as an acrylic polymer, by molding. However, the container 10 may be fabricated from another material, such as a suitable metal, if desired.

Figure 3:
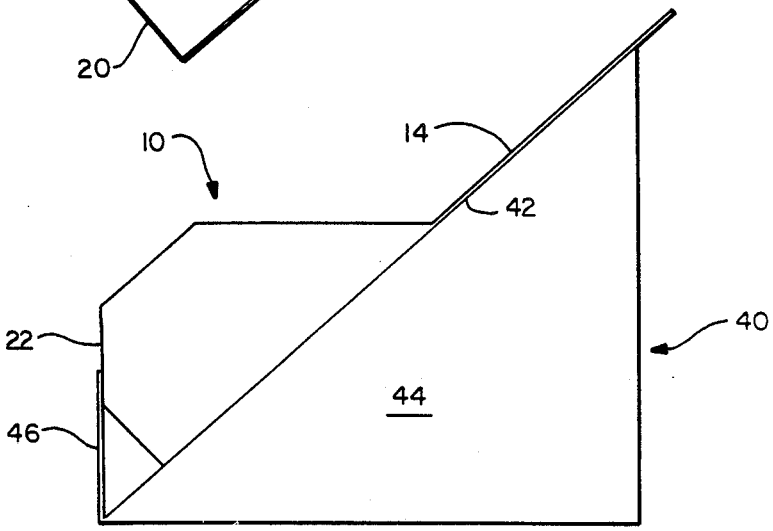
FIG. 3 is a side view of the container shown in FIGS. 1 and 2 positioned with an accessory.

FIG. 3 shows a stand 40 on which a container 10 may be rested while filling the container 10. The stand 40 rests on a table or bench in a florist's workroom. The stand 40 has an inclined top surface 42 on which the bottom 14 of the container 10 rests. Triangular sides 44 of the stand position the surface 42 at a 40 degree angle when the stand 40 rests on a horizontal surface. Vertically extending end 46 of the stand 40 engages the side 22 of the container 10 to position the container 10 on the surface 42 of the stand 40.

Figure 4:
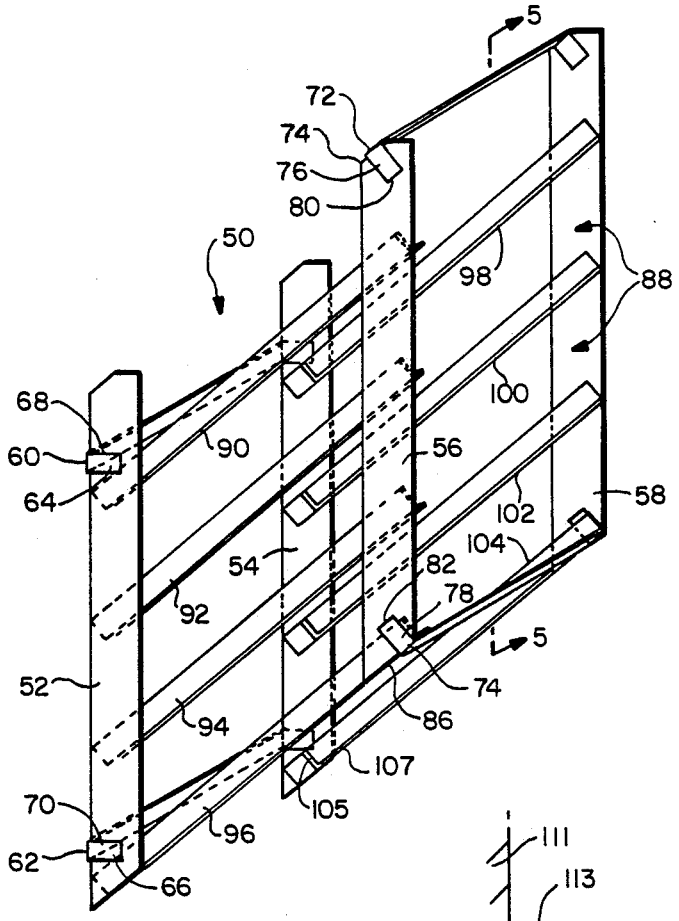
FIG. 4 is a perspective view of a rack in accordance with the invention used with the container of FIGS. 1 and 2.
Figure 5:
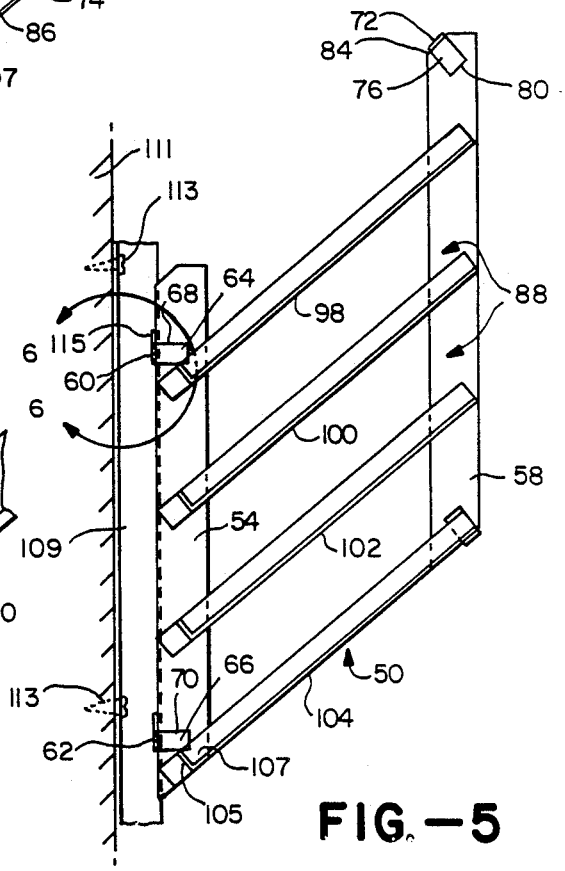
FIG. 5 is a cross-section view taken along the line 5—5 in FIG. 4.

FIGS. 4 and 5 show a rack 50, which holds four of the containers 10. The rack 50 can be hung on a wall or otherwise supported in a vertical position to display the flowers 12 in the containers 10. The rack 50 is formed from four vertical supports 52, 54, 56 and 58. The supports 52 and 54 are joined together by braces 60 and 62 having angled ends 64 and 66 brazed or otherwise fastened flush to the supports 52 and 54 in slots 68 and 70. Braces 72 and 74 join the supports 56 and 58 together in the same manner by means of their angled ends 76 and 78 in slots 80 and 82. The braces 72 and 74 are attached to the supports 56 and 58 at edges 84 and 86 so that front 88 of the rack 50 is unobstructed for insertion and removal of the containers 10. Angles 90, 92, 94, and 96 join the vertical support 52 to the vertical support 56, and angles 98, 100, 102 and 104 join the vertical supports 54 and 58. The angles 90–104 are inclined at an angle of 40 degrees, so that they support the containers 10 at the proper orientation. Tabs 105 extend at right angles to the supporting surfaces 107 of the angles 90–104 near the vertical supports 52 and 54 to provide stops against which the sides 22 of the containers 10 rest when the containers 10 are inserted in the rack 50. The rack 50 is desirably fabricated from suitable metal parts, such as aluminum.

Figure 6:
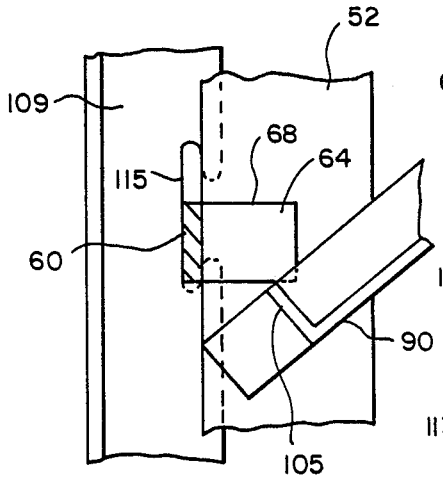
FIG. 6 is an enlarged representation of the region indicated by the line 6—6 in FIG. 5.

The rack 50 is hung on the walls of a refrigerated cooler to store the cut flowers 12, as shown in FIGS. 5 and 6. 'Angles 109 are attached vertically on a wall 111 by screws 113, preferably along studs in the wall for extra support. The angles 109 have notches 115 into which the braces 60 and 62 fit to hold the rack 50 in place. The shape of the notches 115 allows the angles 109 to be attached to the wall 111 with either end up. Four of the containers 12 can be carried at once in the rack 50, which is then hung on a wall in the store, at a cash register, or at other locations in the store to display the flowers 12. A number of the racks 50 are hung together on a wall to create an impressive display of a wall of flowers.

Figure 7:
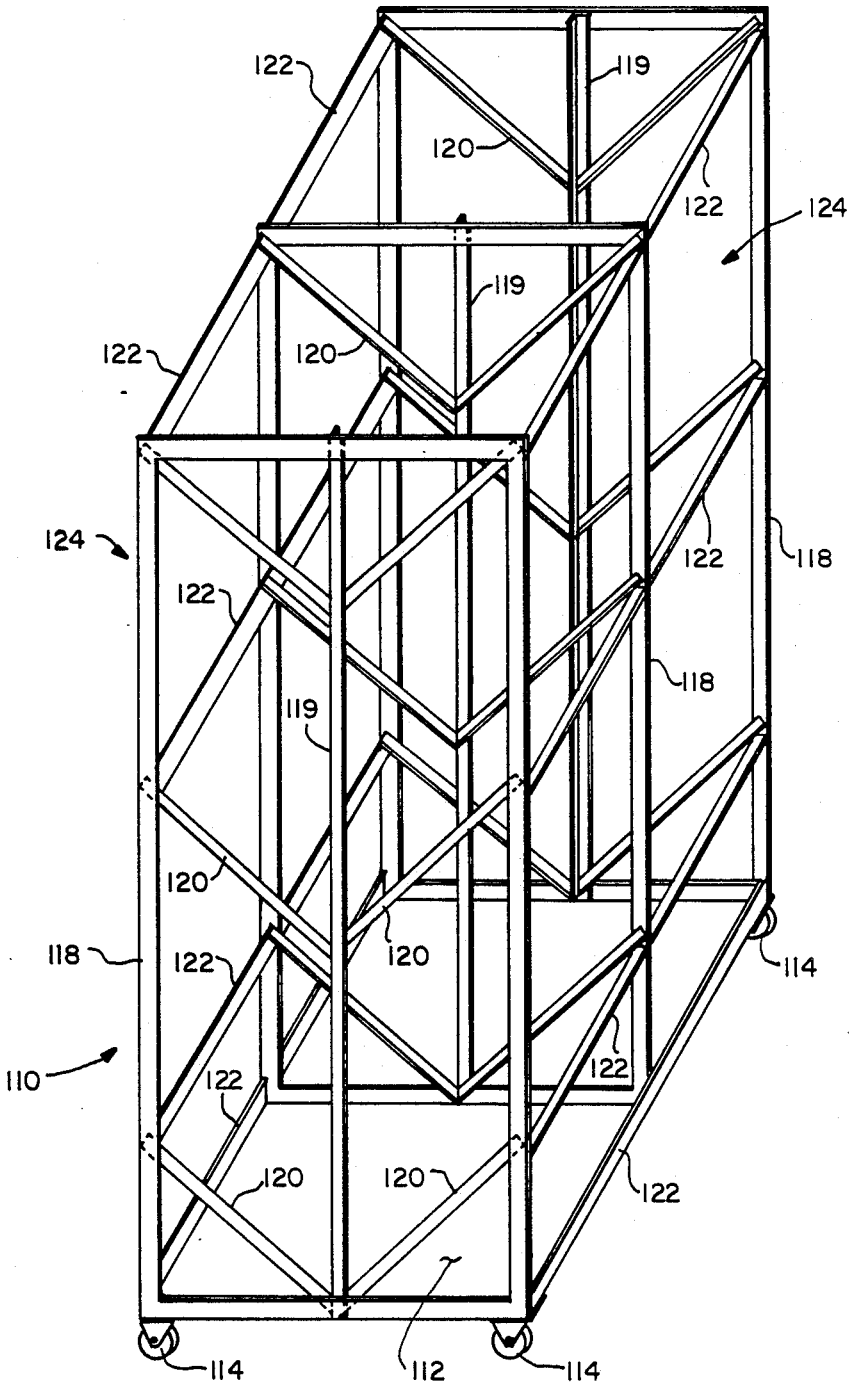
FIG. 7 is a perspective view of a movable tower in accordance with the invention for use with the container of FIGS. 1 and 2 and the rack of FIGS. 4 and 5.

FIG. 7 shows a movable tower 110 which supports twelve of the racks 50 for removable storage in a walk-in cooler as well as for display in a store. The tower 110 has a flat base 112 with casters 114 mounted on the underside of the base 112. Vertical supports 118 and 119 extend upward from the base 112. Angles 120 extend between the vertical supports 118 and 119, and are inclined at 40 degrees with respect to the horizontal to support the racks 50 with their supports 52–58 in a vertical position. Horizontal supports 122 also extend between the vertical supports 118. The supports 118, 119 and 120 and the angles 120 form eight bins 124 into which racks 50 slide. The top four racks 50 nestle in the top angles 120 without other side retaining members. In addition to storage and display, the tower 110 can be used to move racks 50 between a storage cooler and individual point of sale stations, with one or more of the racks 50 being removed from the tower 110 at each point of sale station, then returned to the tower 110 for return to the storage cooler. A modified form of tower could also be provided, in which notches of the same type as the notches 115 in FIGS. 5 and 6 are provided on vertical support members, so that the racks 50 can be hung on the tower in the same manner they are hung on the wall in FIGS. 5 and 6.

Figure 8:
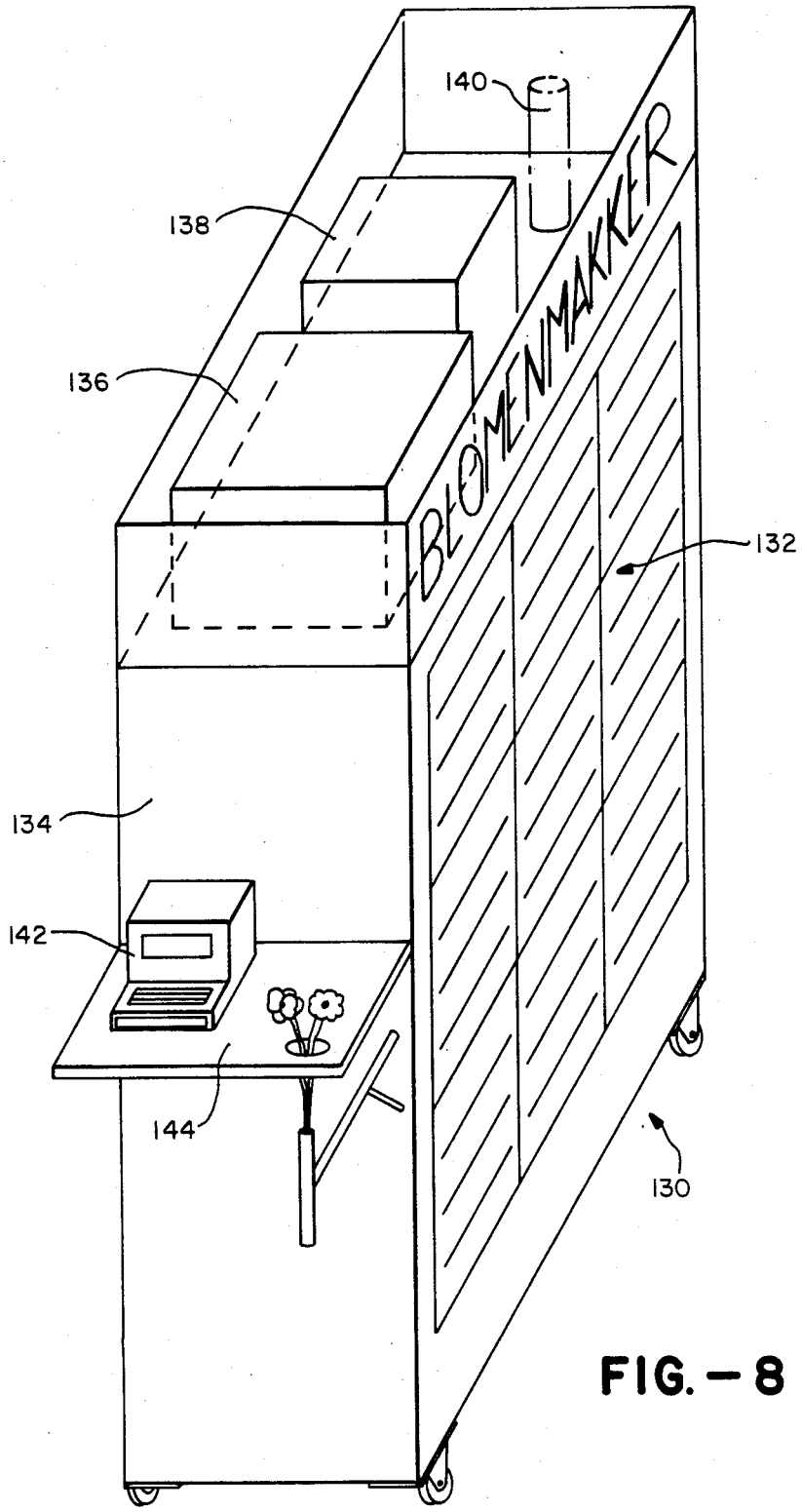
FIG. 8 is a perspective view of a movable sales stand in accordance with the invention for use with the container of FIGS. 1 and 2.

FIG. 8 shows a refrigerated mobile cut flower cart 130, which holds 18 of the containers 10. The cart incorporates one side of a structure 132 corresponding to half of the tower 110 (FIG. 7) inside a housing 134. A refrigeration compressor 136 and coils 138 are mounted on top of the cart 130. An optional propane tank 140 is used for a gas refrigeration system when electric power is not available for the refrigeration. A cash register 142 and work table 144 are provided on one end of the housing 134.

Figure 9:
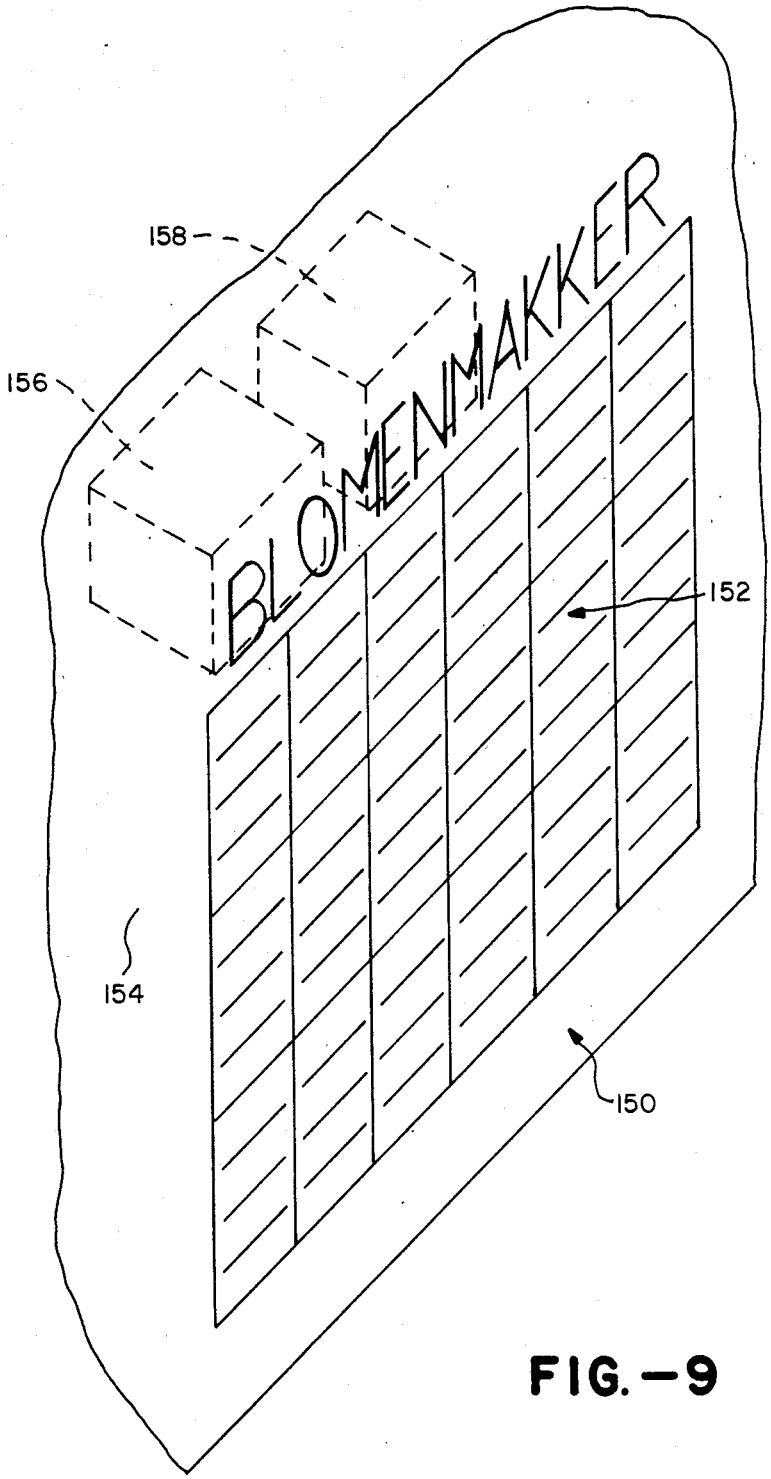
FIG. 9 is a perspective view of a built-in wall display unit in accordance with the invention for use with the container of FIGS. 1 and 2.

FIG. 9 shows a built-in, refrigerated wall unit 150, in which structure 152 corresponding to half of the tower 110 (FIG. 7) is recessed in a wall 154. A refrigeration compressor 156 and coils 158 are provided in the wall 154 above the structure 152.

It should now be readily apparent to those skilled in the art that a novel container, rack and system for storing and displaying cut flowers capable of achieving the stated objects of the invention has been provided. The containers are configured for holding the cut flowers in a manner that will maintain their freshness while they are stored and displayed. The rack and tower allow the cut flowers to be stored and displayed in a high density manner that makes efficient use of expensive cooler space and retail sales space in a store. The rack allows a high density of the flowers to be stored per square foot of floor space, for example, six cubic feet of cut flowers per square foot of floor space. The tower allows 4.5 cubic feet of flowers per square foot of floor space in the configuration shown.

It should further be apparent to those skilled in the art that various changes in form and details of the invention as shown and described may be made. It is intended that such changes be included within the spirit and scope of the claims appended hereto.

What is claimed is:

1. A container for cut flowers having stems, which comprises a generally flat bottom, a pair of sides extending from an end of said generally flat bottom at least partly along opposite sides of said generally flat bottom, a third side extending along the end of said generally flat bottom between said pair of sides, extending at a right angle to said generally flat bottom, a fourth side extending along an edge of said third side at an angle to said third side between said third side and said top, said fourth side extending vertically when said generally flat bottom is angled upward from the end at a predetermined angle, and a top extending between said pair of sides, said sides, bottom and top defining a reservoir for a liquid at the end of said flat bottom, said reservoir having an open side facing away from the end of said flat bottom, said flat bottom extending beyond said reservoir to provide support for the stems of the flowers, said reservoir serving to confine the liquid at the end of said flat bottom when said flat bottom is angled upward from the end.

2. The container for cut flowers of claim in which said container has a row of apertures in said bottom extending between said pair of sides, said row of apertures serving to limit a depth of the fluid in said reservoir when said generally flat bottom is angled upward from the end.

3. The container for cut flowers of claim 1 in which said container is integrally formed from a plastic material.

4. The container for cut flowers of claim 1 in which the predetermined angle is between about 30 and about 50 degrees.

5. The container for cut flowers of claim 4 in which the predetermined angle is about 40 degrees.

* * * * *